US007637765B2

(12) United States Patent
Chang et al.

(10) Patent No.: US 7,637,765 B2
(45) Date of Patent: Dec. 29, 2009

(54) LAMP SOCKET, BACKLIGHT ASSEMBLY HAVING THE SAME AND METHOD FOR ASSEMBLING THE SAME

(75) Inventors: Woong-Jae Chang, Cheonan-si (KR); Jung-Tae Kang, Suwon-si (KR); Jin-Ho Ha, Suwon-si (KR); Yoon-Soo Kwon, Anyang-si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 11/931,931

(22) Filed: Oct. 31, 2007

(65) Prior Publication Data

US 2008/0106900 A1 May 8, 2008

(30) Foreign Application Priority Data

Nov. 7, 2006 (KR) ..... 10-2006-0109316

(51) Int. Cl.
*H01R 4/50* (2006.01)

(52) U.S. Cl. ..... 439/336

(58) Field of Classification Search ..... 439/336, 439/168, 699.2, 881; 362/421, 548
See application file for complete search history.

(56) References Cited

U.S. PATENT DOCUMENTS

| | | | | |
|---|---|---|---|---|
| 5,823,806 | A * | 10/1998 | Nagase et al. | 439/140 |
| 6,984,056 | B2 * | 1/2006 | Amano et al. | 362/225 |
| 7,204,711 | B2 * | 4/2007 | Garcia et al. | 439/336 |
| 2007/0183149 | A1 * | 8/2007 | Ko et al. | 362/225 |

* cited by examiner

*Primary Examiner*—Jean F Duverne
(74) *Attorney, Agent, or Firm*—Cantor Colburn LLP

(57) ABSTRACT

A lamp socket includes a socket body, a power supplying member and a socket cover. The socket body has a connecting hole formed in the socket body. The connecting hole is opened. The power supplying member is disposed in the connecting hole and an electrode supporting terminal having a supporting groove, so that supports an electrode portion of a lamp disposed in the power supplying member. The socket cover is partially and separably insertable in the connecting hole, to fix the electrode portion of the lamp. A backlight assembly includes a receiving container, a plurality of lamps and lamp sockets.

24 Claims, 13 Drawing Sheets

LAMP SOCKET, BACKLIGHT ASSEMBLY HAVING THE SAME AND METHOD FOR ASSEMBLING THE SAME

This application claims priority to Korean Patent Application No. 2006-109316, filed on Nov. 7, 2006, and all the benefits accruing therefrom under 35 U.S.C. § 119, the contents of which in its entirety are herein incorporated by reference.

BACKGROUND OF THE INVENTION

1. Field of the Invention

The present invention relates to a backlight assembly. More particularly, the present invention relates to a lamp socket, a backlight assembly having the lamp socket, and a method for assembling the lamp socket.

2. Description of the Related Art

A backlight assembly used in a liquid crystal display ("LCD") apparatus is classified into a direct-illumination type backlight assembly and an edge-illumination type backlight assembly according to an arrangement of a light source.

A cold cathode fluorescent lamp (CCFL) is mainly used for the light source of the backlight assembly. The direct-illumination type backlight assembly having the CCFL includes a lamp holder or a lamp socket to fix the lamps to a bottom plate of a receiving container.

When the lamp holder is used to fix the lamps to the bottom plate of the receiving container, an electrode portion of the lamp and a wire are connected via a soldering process, and the lamps are manually combined with the lamp holder, so that many problems such as deterioration of a reliability of the soldering and so on exist in the assembling performance. In order to solve the problems, a lamp socket matched up with the electrode portion of the lamps has been developed. The lamp socket fixes the lamp to the receiving container and is combined with the electrode portion of the lamp without the soldering process. Thus, a lamp socket type backlight assembly may have the better assembling performance and the better reliability than a lamp holder type backlight assembly.

In the lamp socket type backlight assembly, a design of a socket body including a plastic based material and a power applying terminal including a metal based material is important. Particularly, the CCLF is fragile to an external impact. Thus, the power applying terminal and the socket body are required to decrease an insertion force and to increase the reliability of electrical contact, when a lead wire of the lamp is inserted into the power applying terminal.

BRIEF SUMMARY OF THE INVENTION

An exemplary embodiment provides a lamp socket for decreasing damages induced by an external impact and enhancing a reliability of an electrical connection.

An exemplary embodiment provides a backlight assembly having the exemplary lamp socket.

An exemplary embodiment provides a method for assembling the exemplary lamp socket.

In an exemplary embodiment of a lamp socket, the lamp socket includes a socket body, a power supplying member and a socket cover. The socket body has a connecting hole formed through the socket body. The connecting hole is opened. The power supplying member is disposed in the connecting hole and has an electrode supporting terminal having a supporting groove formed at an upper portion of the electrode supporting terminal, to support an electrode portion of a lamp disposed in the power supplying member. The socket cover is at least partially insertable into the connecting hole to be separably combined with the socket body, to fix the electrode portion of the lamp. In an exemplary embodiment, the lamp socket further may include an electrode fixing member. The electrode fixing member may include a first lamp connecting terminal and a second lamp connecting terminal. The first lamp connecting terminal may have a first fixing portion combined with the socket cover, and a first contact portion upwardly curved from the first fixing portion to make contact with a first side of the electrode portion. The second lamp connecting terminal may have a second fixing portion combined with the socket cover to face the first fixing portion, and a second contact portion upwardly curved from the second fixing portion to make contact with a second side of the electrode portion. The first and second lamp connecting terminals which make contact with the electrode portion may be disposed to have a W-shape when viewed in a longitudinal direction of the lamp. Left and right inner surfaces of the socket body defining the connecting hole may include an inclined surface guiding the first and second lamp connecting terminals so that a distance between the first and second lamp connecting terminals may become narrower.

In an exemplary embodiment, a distance control protrusion may protrude from at least one of front inner surface and a rear inner surface of the socket body defining the connecting hole. Here, the front and rear inner surfaces face the power supplying member. The distance control protrusion may be disposed between the first and second contact portions to control the distance between the first and second contact portions in accordance with a position of the socket cover. The first and second contact portions may make contact with the distance control protrusion to be separated from the electrode portion when a lower portion of the socket cover is inserted into the connecting hole to be in a first position, and the first and second contact portions may be separated from the distance control protrusion to respectively make contact with both sides of the electrode portion when the socket cover is inserted into the connecting hole to be in a second position that is lower than the first position. The power supplying member may include an inverter connecting terminal integrally formed with the electrode supporting terminal and disposed at the lower portion of the connecting hole. The electrode portion is disposed on the supporting groove. The power supplying member may further include guide portions which protrude from left and right edges of the electrode supporting terminal, and the first and second lamp connecting terminals are insertable between the guide portions.

In an exemplary embodiment, the socket cover may include a first cover portion having a first fixing groove, into which the first fixing portion is inserted, and a second cover portion having a second fixing groove, into which the second fixing portion is inserted. Here, the second cover portion is integrally formed with the first cover portion such that the second cover portion faces the first cover portion. Combining holes may be formed through the left and right inner surfaces of the socket body defining the connecting hole, and combining protrusions which are insertable into the combining holes are formed on side surfaces of the first and second cover portions. A lamp guide groove on which an end portion of the lamp is disposed, may be formed at an upper surface of the socket body.

In an exemplary embodiment, the lamp socket may further include a socket cap. The socket cap has a contact portion which encloses and makes contact with the electrode portion, and hook portions extended from left and right end portions of the contact portion to be hooked with left and right upper portions of the socket body. The supporting groove supports an electrode portion of a lamp being disposed thereon. The socket cap may include metal.

In an exemplary embodiment of a backlight assembly, the backlight assembly includes a receiving container, a plurality of lamps and a plurality of lamp sockets. The receiving container includes a bottom plate having a plurality of openings formed through the bottom plate, and a side wall disposed on a peripheral portion of the bottom plate. Each of the plurality of lamps includes a lamp body disposed over the bottom plate, and an electrode portion formed at an end portion of the lamp body. Each of the lamp sockets includes a socket body, a power supplying member and a socket cover. The socket body is combined with each of the openings, and has a connecting hole formed through the socket body. The connecting hole is opened to inner and outer sides of the receiving container. The power supplying member is disposed in the connecting hole and has an electrode supporting terminal having a supporting groove formed at an upper portion of the electrode supporting terminal, to support the electrode portion. The socket cover is at least partially insertable into the connecting hole to be separably combined with the socket body, to fix the electrode portion of the lamp. In an exemplary embodiment, each of the lamp sockets may include the electrode fixing member. The electrode fixing member may include a first lamp connecting terminal having a clamp-shape and which makes contact with a first side of the electrode portion, and a second lamp connecting terminal having the clamp-shape corresponding to the first lamp connecting terminal and which makes contact with a second side of the electrode portion. A distance control protrusion may be formed on an inner surface of the socket body defining the connecting hole, and the distance control protrusion may be disposed between the first and second lamp connecting terminals to control a distance between the first and second lamp connecting terminals and the electrode portion in response to an external force applied to the socket cover.

In an exemplary embodiment, the backlight assembly may further include a power supplying board having a power output terminal formed on the power supplying board. The power output terminal makes contact with the power supplying member exposed to a rear surface of the bottom plate. The backlight assembly may further include a connecting member having a plurality of socket fixing portions formed at the connecting member. The lamp sockets may be fixed to the socket fixing portions to be aligned in the openings.

In an exemplary embodiment of a method for assembling a lamp socket, the method includes forming a connecting hole of a socket body through the socket body, and the connecting hole is opened. A power supplying member in the connecting hole is disposed to support an electrode portion of a lamp disposed in the power supplying member. The power supplying member has an electrode supporting terminal having a supporting groove formed at an upper portion of the electrode supporting terminal. A socket cover insertable into the connecting hole is separably combined with the socket body.

In an exemplary embodiment, the lamp socket includes an electrode fixing member having first and second lamp connecting terminals. A first fixing portion of the first lamp connecting terminal is combined with the socket cover. A first contact portion of the first lamp connecting terminal is upwardly curved from the first fixing portion to make contact with a first side of the electrode portion. A second fixing portion of the second lamp connecting terminal is combined with the socket cover to face the fixing portion. A second contact portion of the second lamp connecting terminal is upwardly curved from the second fixing portion to make contact with a second side of the electrode portion.

In an exemplary embodiment, a lamp guide groove is formed at an upper surface of the socket body. The lamp guide groove allows an end portion of the lamp to be disposed thereon.

In exemplary embodiments of the present invention, the lamp and the lamp socket, and the lamp socket and the power supplying board may be easily assembled, and reliability of the electrical connection between the electrode portion of the lamp and the terminal of the lamp socket may be enhanced.

BRIEF DESCRIPTION OF THE DRAWINGS

The above and other features and advantages of the present invention will become more apparent by describing in detailed exemplary embodiments thereof with reference to the accompanying drawings, in which.

DETAILED DESCRIPTION OF THE INVENTION

Figure 1:
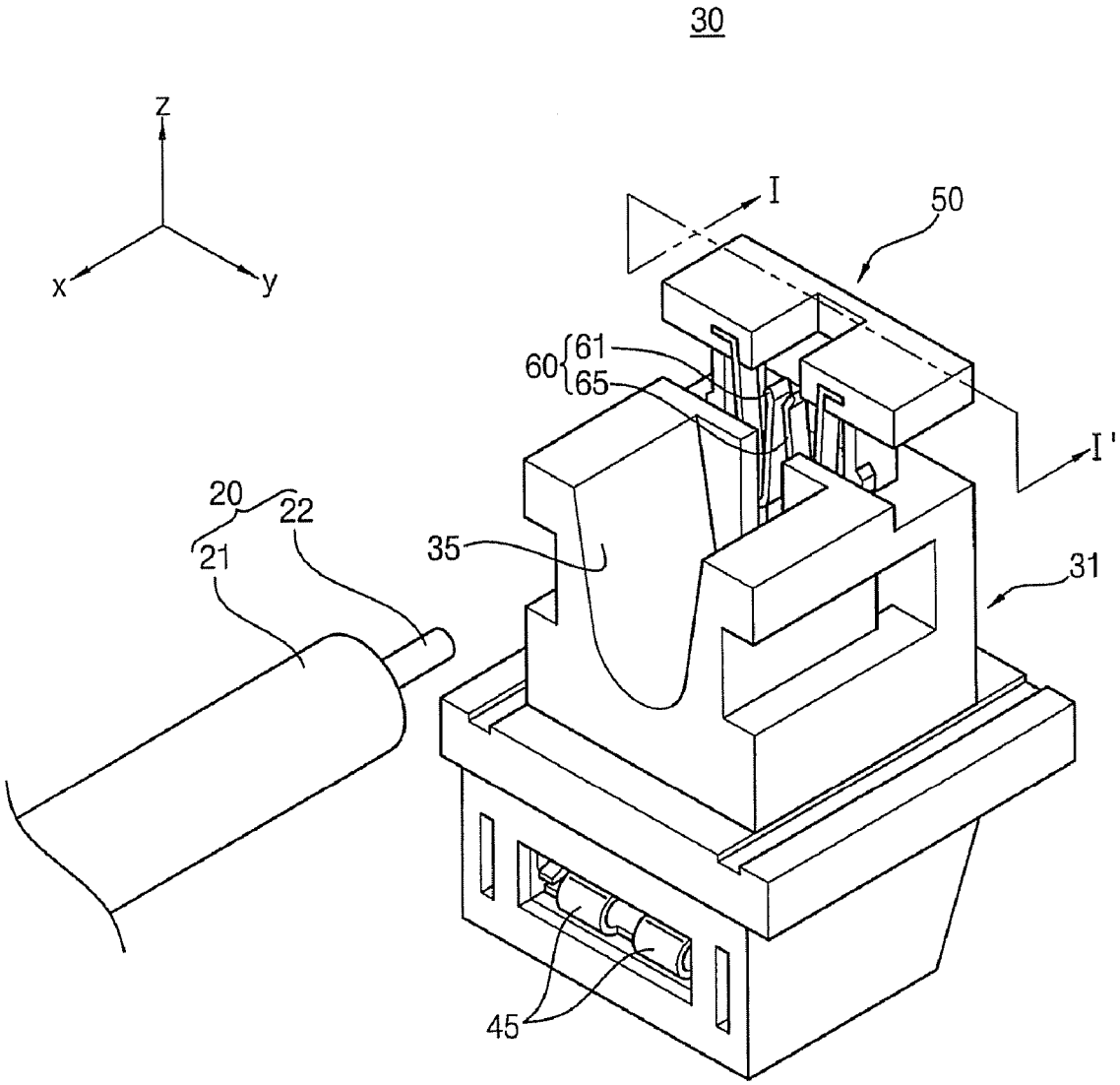
FIG. 1 is a perspective view illustrating an exemplary embodiment of a lamp socket according to the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," or "connected to" another element or layer, it can be directly on or connected to the other element or layer or intervening elements or layers may be present. In contrast, when an element is referred to as being "directly on" or "directly connected to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "lower," "under," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "lower" other elements or features would then be oriented "above" the other elements or features. Thus, the term "under" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the present invention will be explained in detail with reference to the accompanying drawings.

Figure 2:
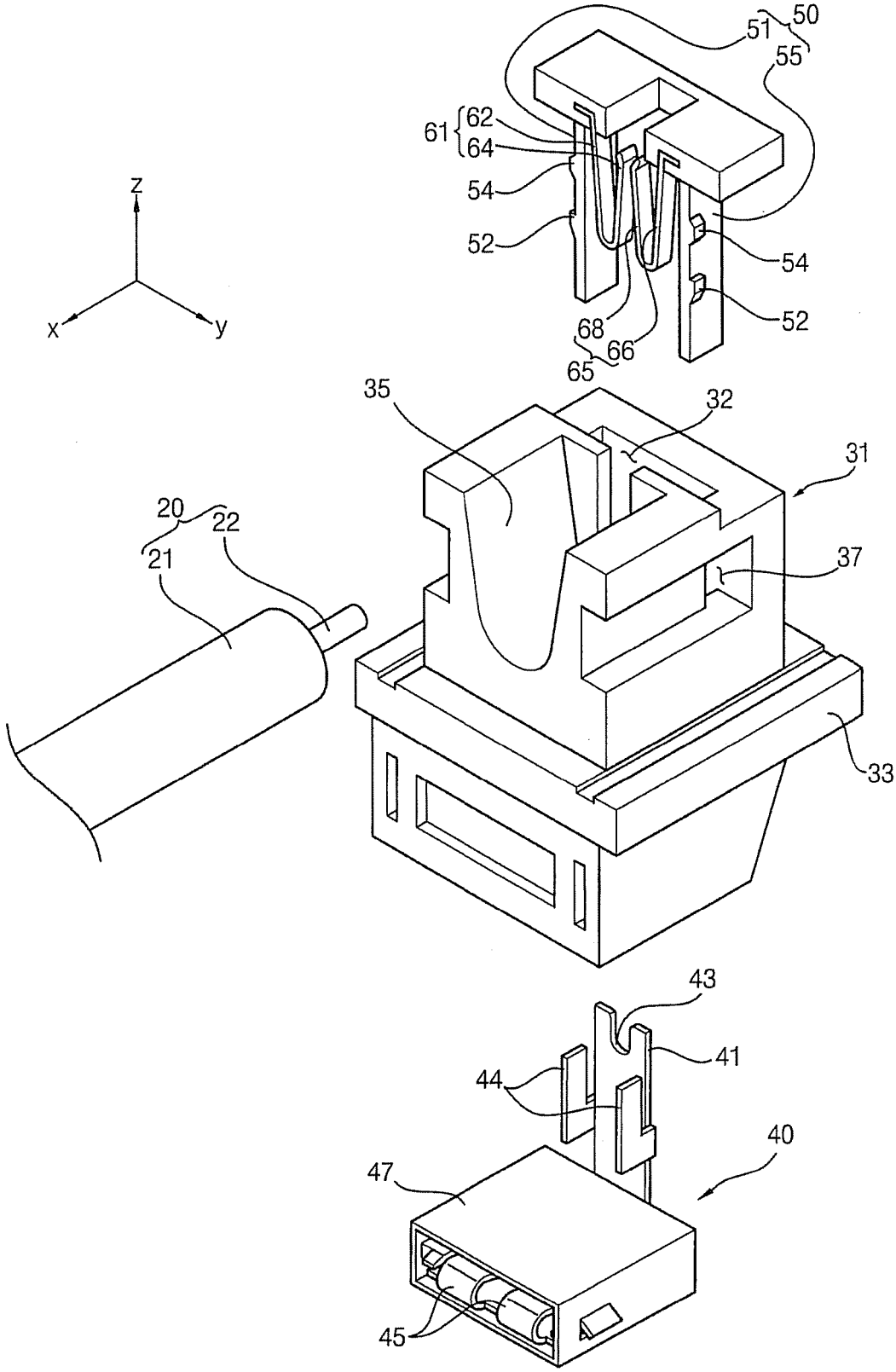
FIG. 2 is an exploded perspective view illustrating the lamp socket in FIG. 1.

FIG. 1 is a perspective view illustrating a first exemplary embodiment of a lamp socket according to the present invention. FIG. 2 is an exploded perspective view illustrating the lamp socket in FIG. 1.

Referring to FIGS. 1 and 2, the lamp socket 30 includes a socket body 31, a power supplying member 40, a socket cover 50 and an electrode fixing member 60. The lamp socket 30 fastens lamps 20, which generate light, to a receiving container (not shown), and applies a driving voltage to the lamps 20.

The socket body 31 is formed through a molding process, and a connecting hole 32 is formed through the socket body 31. The connecting hole 32 is opened from an upper portion of the socket body 31 to a lower portion thereof along a Z-axis direction. A lower portion of the connecting hole 32 is partially opened along an X-axis direction. A stepped portion 33 is further formed surrounding an outside of the socket body 31. A lamp guide groove 35 having a rounded shape is further formed on an upper surface of the socket body 31. The lamp guide groove 35 is opened along the X-axis direction and a positive Z-axis direction. The lamp guide groove 35 is connected to the connecting hole 32 along a negative X-axis direction. An end portion of a lamp body 21 of a lamp 20 is disposed on the lamp guide groove 35. The socket body 31 further includes combining holes 37. The combining holes 37 are formed over the stepped portion 33, and are opened to the Y-axis direction to be connected with the connecting hole 32.

The power supplying member 40 is formed of metal having conductivity, and electrically connects an inverter (not shown) and an electrode portion 22 of the lamp 20 to each other. The power supplying member 40 may include an electrode supporting terminal 41 and an inverter connecting terminal 45 that are integrally formed with each other.

The electrode supporting terminal 41 has a plate-shape extending along the Z-axis direction. A supporting groove 43 is formed at a central portion of an upper edge of the electrode supporting terminal 41. The supporting groove 43 is preferably formed having a larger width than a diameter or width of the electrode portion 22. The power supplying member 40 may further include guide portions 44. The guide portions 44 respectively extend along the X-axis direction from left and right edges of the electrode supporting terminal 41. The guide portions 44 guide the power supplying member 40 to a predetermined position of the connecting hole 32.

The inverter connecting terminal 45 may make physical contact with a power output terminal of the power supplying board (not shown). The inverter connecting terminal 45 may include a spring-shape, for example a leaf spring-shape, for providing a reliable elastic contact. The inverter connecting terminal 45 of the present invention extends along the X-axis direction from a lower edge of the electrode supporting terminal 41 and then extends in the positive Z-axis direction. The inverter connecting terminal 45 is curved again, to extend along the negative X-axis direction by a predetermined distance. Thus, when an external force is applied or eliminated along the Z-axis direction, the inverter connecting terminal 45 may be elastically deformed to have a flat shape or restored.

The power supplying member 40 may further include a shape-maintaining portion 47. The shape-maintaining portion 47 has a hexahedron box shape. The shape-maintaining portion 47 is opened along the X-axis direction. In other words, one of two faces of the shape-maintaining portion 47, which is normal to the X-axis direction are opened. The shape-maintaining portion 47 is connected to an upper portion of the lower edge of the electrode supporting terminal 41. The inverter connecting terminal 45 is disposed inside of the shape-maintaining portion 47.

The power supplying member 40 is inserted into the connecting hole 32 from a lower portion to an upper portion of the connecting hole 32. The upper portion of the electrode supporting terminal 41 is exposed in the upper portion of the connecting hole 32. The inverter connecting terminal 45 is disposed under the connecting hole 32 to be exposed in the positive X-axis direction.

The lamp 20 includes the lamp body 21 and the electrode portion 22 formed at the end portion of the lamp body 21. The end portion of the lamp body 21 is disposed on the lamp guide groove 35 formed in the socket body 31. The electrode portion 22 of the lamp is disposed on the supporting groove 43 formed in the electrode supporting terminal 41. Since the supporting groove 43 is formed to have a larger width than the width or the diameter of the electrode portion 22, an insertion force is not necessary when the electrode portion 22 of the lamp is disposed on the supporting groove 43.

Figure 3:
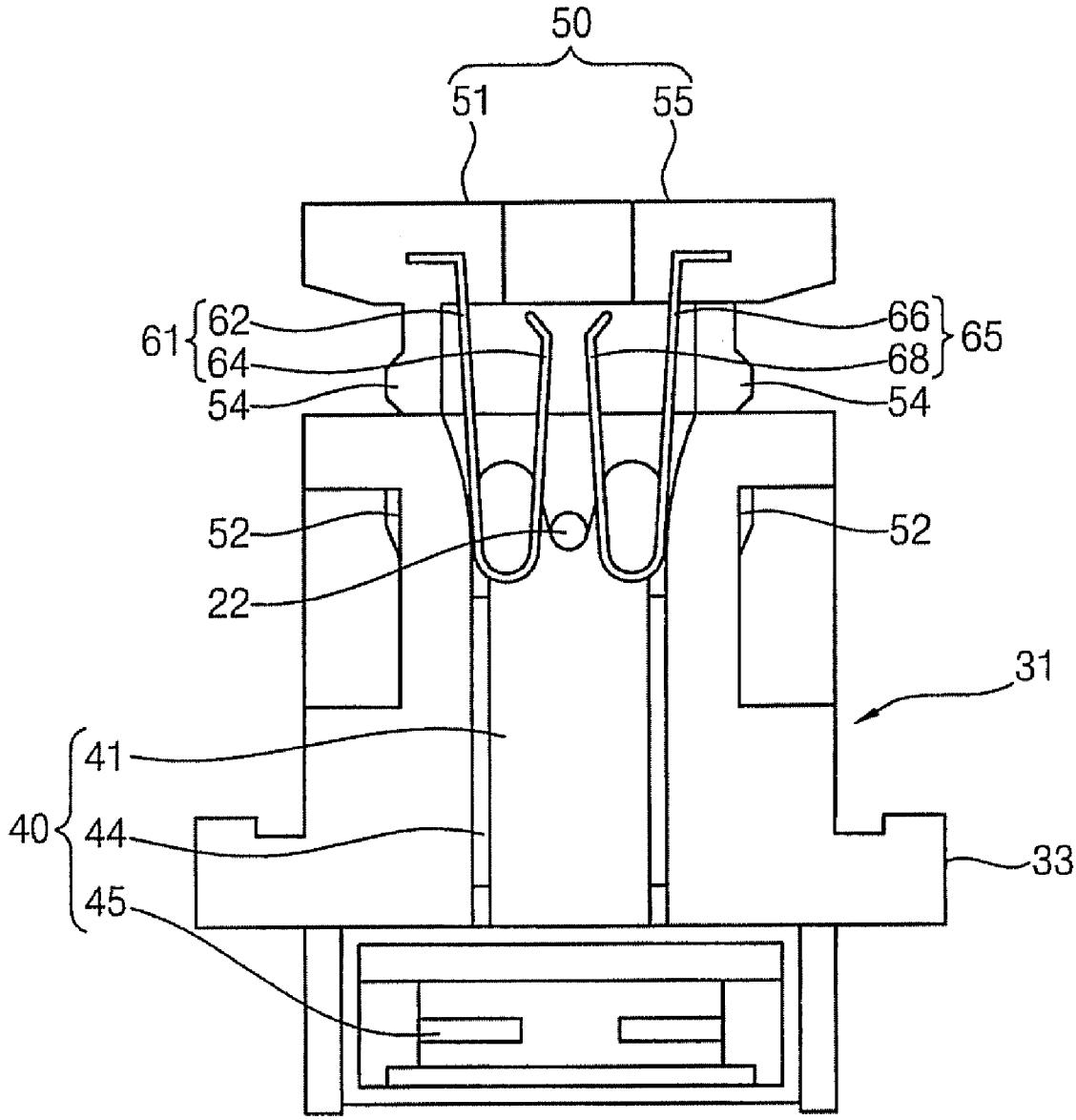
FIG. 3 is a cross-sectional view taken along line I-I' of the lamp socket in FIG. 1.

FIG. 3 is a cross-sectional view taken along line I-I' of the lamp socket 30 in FIG. 1.

Referring to FIGS. 2 and 3, the socket cover 50 fixes the electrode portion 22 to the electrode supporting terminal 41, to enhance the reliability of the electrical connection between the electrode portion 22 and the electrode supporting terminal 41. The socket cover 50 is partially inserted into the connecting hole 32 to be separably combined with the socket body 31. The socket cover 50 is inserted into the connecting hole 32, so that the socket cover 50 may be moved up and down along left and right inner surfaces of the socket body 31 defining the connecting hole 32. The socket cover 50 may include first and second cover portions 51 and 55 integrally formed with each other.

The first and second cover portions 51 and 55 have a bar-shape extending along the Z-axis direction. The first and second cover portions 51 and 55 are separated from each other and are opposite to each other. The first and second cover portions 51 and 55 are extended from first edges facing each other, to be connected with each other. Thus, the first and second cover portions 51 and 55 include a predetermined receiving space or gap formed therebetween.

A first fixing groove having a J shape is formed on a surface of the first cover portion 51 along the positive X-axis direction. A first combining protrusion 52 and a second combining protrusion 54 are formed on a side surface of the first cover portion 51 along a negative Y-axis direction. The second combining protrusion 54 is formed over the first combining protrusion 52. The first and second cover portions 51 and 55 have a substantially symmetric shape with respect to an X-Z plane. Thus, a second fixing groove having the J shape, and the first and second combining protrusions 52 and 54 are formed in the second cover portion 55.

The electrode fixing member 60 is combined with the socket cover 50. The socket cover 50 is inserted into the connecting hole 32 using an external force, so that the electrode fixing member 60 makes contact with the electrode portion 22 of the lamp. The electrode fixing member 60 may be designed in various shapes to fix the electrode portion 22 to the electrode supporting terminal 41. The electrode fixing member 60 according to the present exemplary embodiment includes a first lamp connecting terminal 61 and a second lamp connecting terminal 65, as illustrated in FIG. 1.

The first lamp connecting terminal 61 is combined with the first cover portion 51. The second lamp connecting terminal 65 is combined with the second cover portion 55, and is opposite to the first lamp connecting terminal 61. The first and second lamp connecting terminals 61 and 65 respectively have a clamp shape. For example, the first lamp connecting terminal 61 may include a first fixing portion 62 and a first contact portion 64. The second lamp connecting terminal 65 may include a second fixing portion 66 and a second contact portion 68.

The first fixing portion 62 has a shape corresponding to the first fixing groove having the J shape, and is inserted into the first fixing groove. Thus, an upper end of the first fixing portion 62 extends along the Y-axis direction. The first fixing portion 62 except the upper end of the first fixing portion 62 is curved from the upper end of the first fixing portion 62 and extends to a lower portion of the first fixing portion 62. The first connecting portion 64 is curved from a lower end of the first fixing portion 62 and extends to an upper portion of the first fixing portion 62 between the first and second cover portions 51 and 55.

The second fixing portion 66 has a shape corresponding to the second fixing groove, and is inserted into the second fixing groove. The second connecting portion 68 is curved from a lower end of the second fixing portion 66 and extends to an upper portion of the second fixing portion 66 between the first and second cover portions 51 and 55. The first and second contact portions 64 and 68 are separated from each other and are opposite to each other.

Thus, the first and second lamp connecting terminals 61 and 65 are disposed to be substantially in a W shape when viewed in a longitudinal direction of the lamp 20, for example the X-axis direction.

As illustrated in FIG. 3, when a lower portion of the socket cover 50 is inserted into the connecting hole 32, the first combining protrusions 52 of the socket cover 50 are inserted into the combining holes 37 (FIG. 2) of the socket body 31. When the second protrusions 54 are disposed outside of the connecting hole 32, the socket cover 50 is defined to be in a first position.

In the first position, the electrode portion 22 of the lamp, as illustrated in FIG. 3, is disposed between the first and second contact portions 64 and 68. In the first position, the electrode portion 22 may be disposed below the first and second contact portions 64 and 68. In the first position, the first and second contact portions 64 and 68 may make contact with the electrode portion 22 or be separated from each other.

Figure 4:
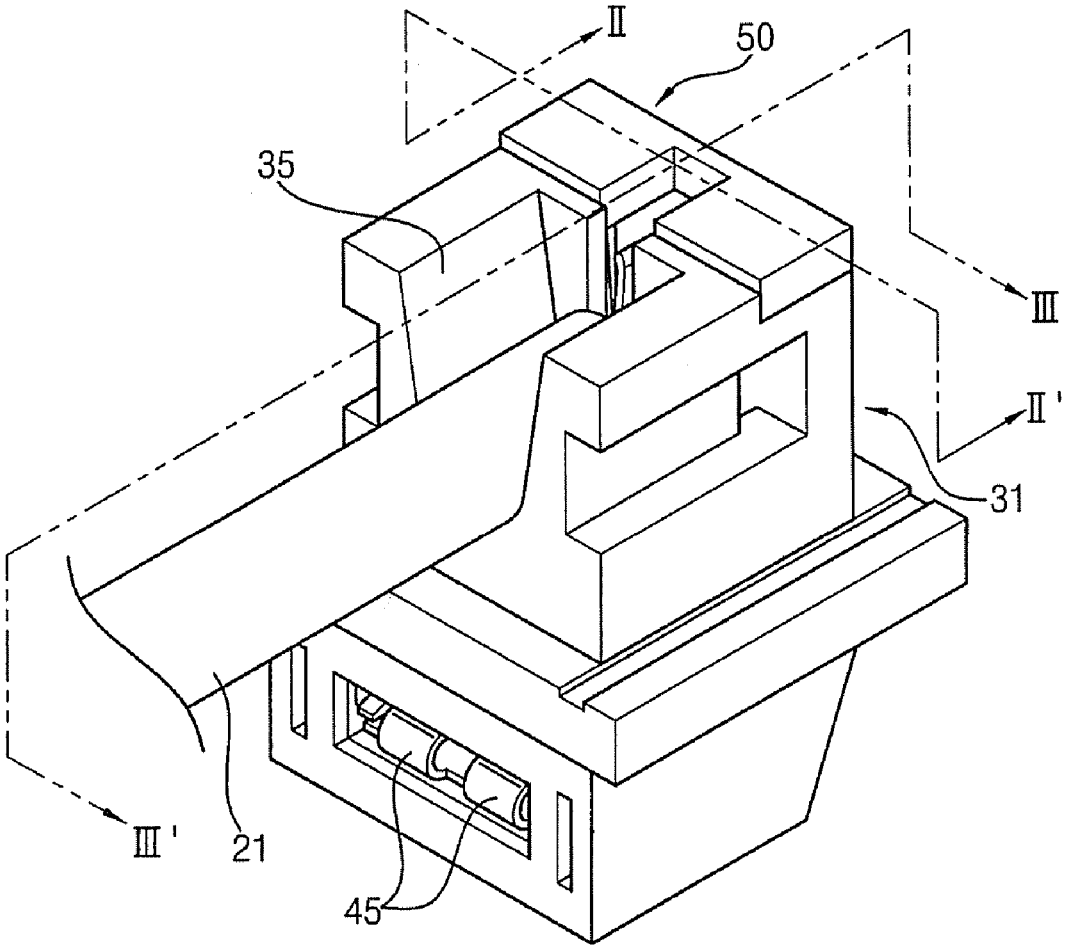
FIG. 4 is another perspective view illustrating the lamp socket in FIG. 1.
Figure 5:
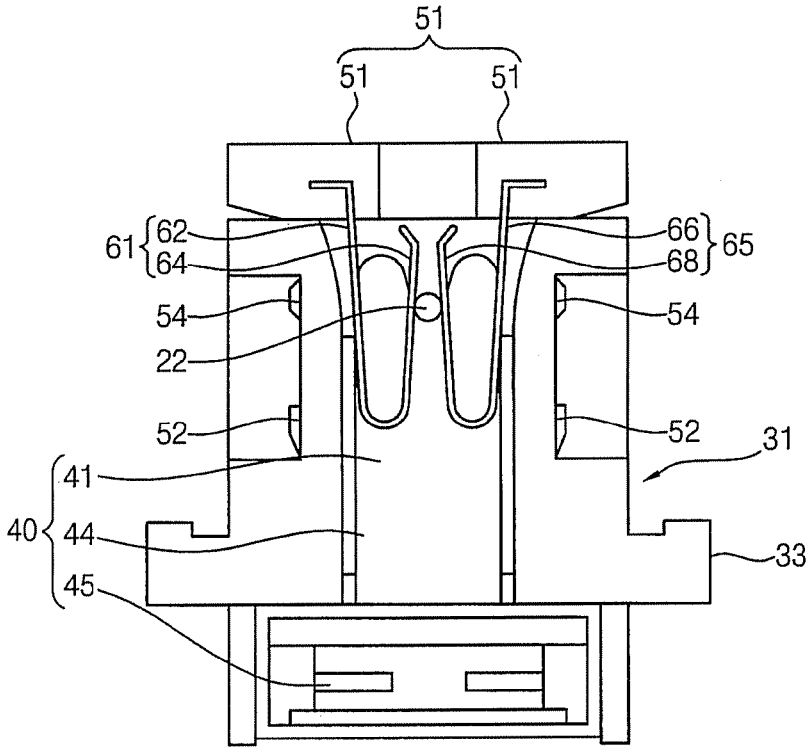
FIG. 5 is a cross-sectional view taken along line II-II' of the lamp socket in FIG. 4.
Figure 6:
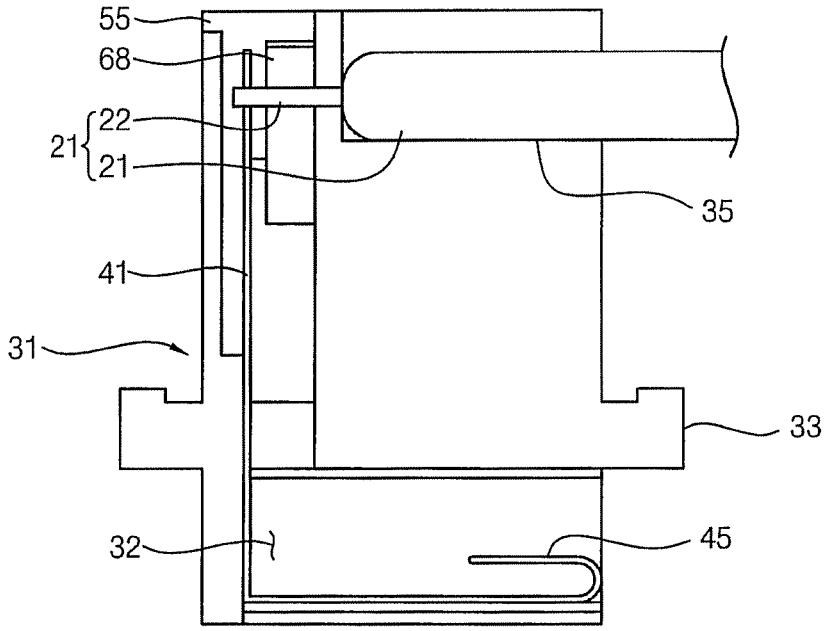
FIG. 6 is a cross-sectional view taken along line III-III' of the lamp socket in FIG. 4.

FIG. 4 is another perspective view illustrating the lamp socket 30 in FIG. 1. FIG. 5 is a cross-sectional view taken along line II-II' of the lamp socket 30 in FIG. 4. FIG. 6 is a cross-sectional view taken along line III-III' of the lamp socket 30 in FIG. 4. FIGS. 4, 5 and 6 illustrate the socket cover 50 inserted more fully into the connecting hole.

As illustrated in FIGS. 4, 5 and 6, when the external force is applied to the socket cover 50 for the first and second combining protrusions 52 and 54 to be fully inserted into the combining hole 37 (see FIG. 2) of the socket body 31, the socket cover 50 is defined to be in a second position.

Referring to FIGS. 3 and 5, inclined surfaces are respectively formed on both surfaces of the socket body 31 defining the connecting hole 32 along the Y-axis direction. In the first position, the inclined portion of the first and second lamp connecting terminals 61 and 65 is hooked on the inclined surface. When the socket cover 50 is compressed from an upper portion, the first and second fixing portions 62 and 66 are respectively guided along the inclined surfaces.

Thus, the separated distance between the first and second contact portions 64 and 68 becomes narrower in the second position than in the first position. Accordingly, the first and second fixing portions 62 and 66 are inserted between the guide portions 44 of the power supplying member 40. In addition, the first and second contact portions 64 and 68 respectively make contact with both sides of the electrode portion 22. Thus, the power supplying member 40, the electrode fixing member 60 and the electrode portion 22 are electrically connected with one another in the second position.

Movement of the electrode portion 22, as illustrated in FIGS. 5 and 6, is constrained along the Z-axis direction and the Y-axis direction by the electrode supporting terminal 41, and the first and second contact portions 64 and 68, respectively. Thus, constraint of movement along the Z-axis and Y-axis directions ensures reliability of the electrical connection between the electrode supporting terminal 41 and the electrode portion 22.

Figure 7:
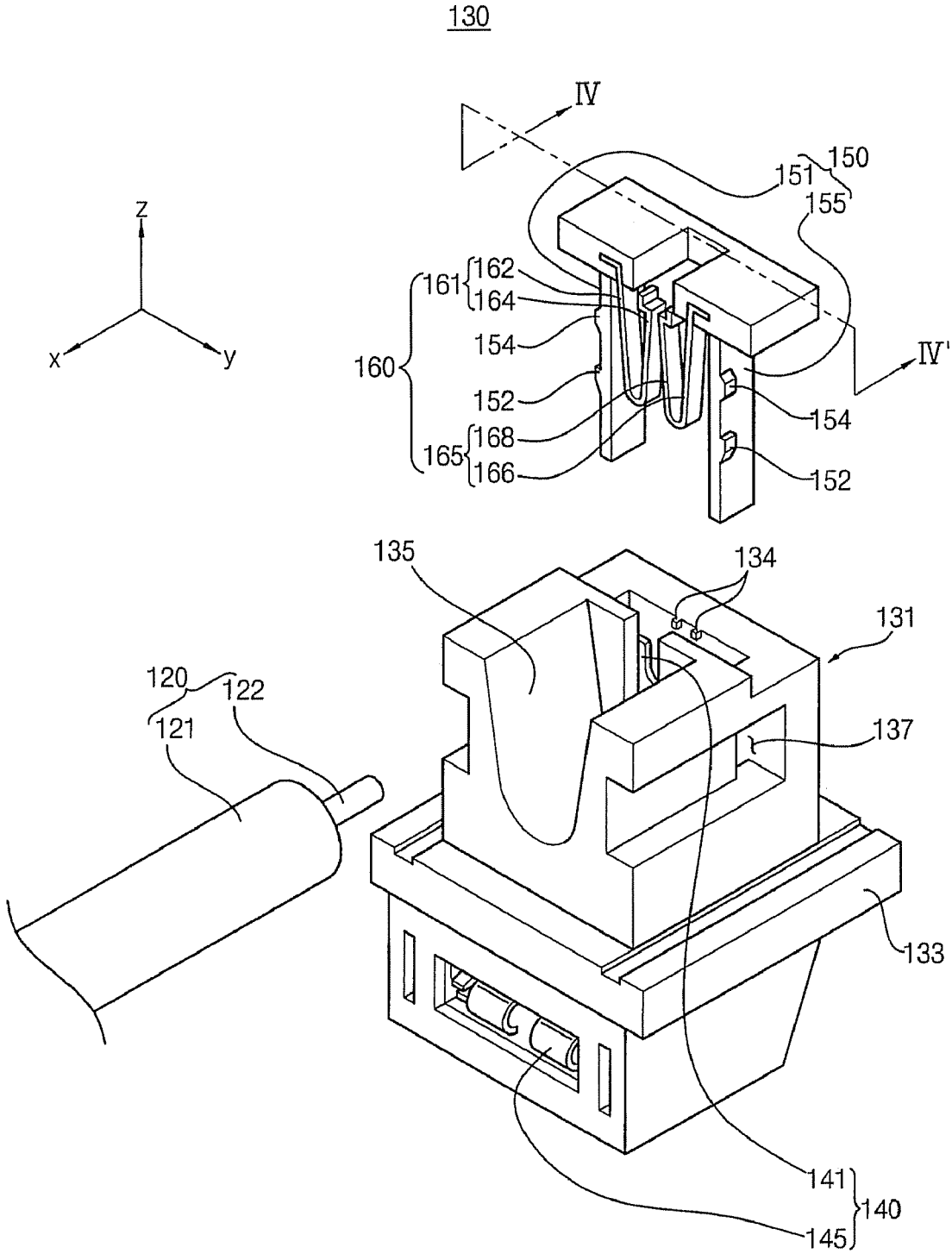
FIG. 7 is an exploded perspective view illustrating a second exemplary embodiment of a lamp socket according to the present invention.

FIG. 7 is an exploded perspective view illustrating a second exemplary embodiment of a lamp socket according to the present invention.

Referring to FIG. 7, the lamp socket 130 includes a socket body 131, a power supplying member 140, a socket cover 150 and an electrode fixing member 160. The lamp socket 130 according to the present exemplary embodiment is substantially the same as the lamp socket 30 illustrated in FIGS. 1 to 6, except for the socket body 131 and the electrode fixing member 160.

The socket body 131 according to the present exemplary embodiment is substantially the same as the socket body 31 illustrated in FIGS. 1 to 6, except that the socket body 131 includes a distance control protrusion 134. Thus, a connecting hole 132 opened along the Z-axis direction is formed through the socket body 131, and a combining hole 137 is formed through side surfaces along the Y-axis direction in the socket body 131. A power supplying member 140 is inserted into the connection hole 132. An electrode supporting terminal 141 of the power supplying member 140 is disposed in an upper portion of the connecting hole 132, and the inverter connecting hole 145 is disposed in a lower portion of the connecting hole 132 to be exposed in the positive X-axis direction.

The electrode fixing member 160 includes a first lamp connecting terminal 161 and a second lamp connecting terminal 165. The first lamp connecting terminal 161 includes a first fixing portion 162 and a first contact portion 164. The second lamp connecting terminal 165 includes a second fixing portion 166 and a second contact portion 168. The first and second lamp connecting terminals 161 and 165 according to the present exemplary embodiment are substantially the same as the first and second lamp connecting terminals 61 and 65 illustrated in FIGS. 1 to 6, except for the shapes of the first and second contact portions 164 and 168.

When an external force is not applied, the first and second contact portions 164 and 168 may make contact with each other. An upper portion of the first contact portion 164 is curved to the negative Y-axis direction, and the upper portion of the second contact portion 168 is curved to the positive Y-axis direction. Thus, when the external force is not applied, the first and second contact portions 164 and 168 may be disposed to have a V-shape.

The distance control protrusion 134 controls the separated distance between the first and second contact portions 164 and 168 in accordance with the position of the socket cover 150. The distance control protrusion 134 may be formed on an inner surface of the socket body 131 defining the connecting hole 132 facing the electrode supporting terminal 141. The distance control protrusion 134 according to the present exemplary embodiment protrudes between the first and second contact portions 164 and 168 from an inner surface of the socket body 131 defining the connecting hole 132 along the negative X-axis. The distance control protrusion 134 is formed over the electrode portion 122 disposed in the electrode supporting terminal 141.

Figure 8:
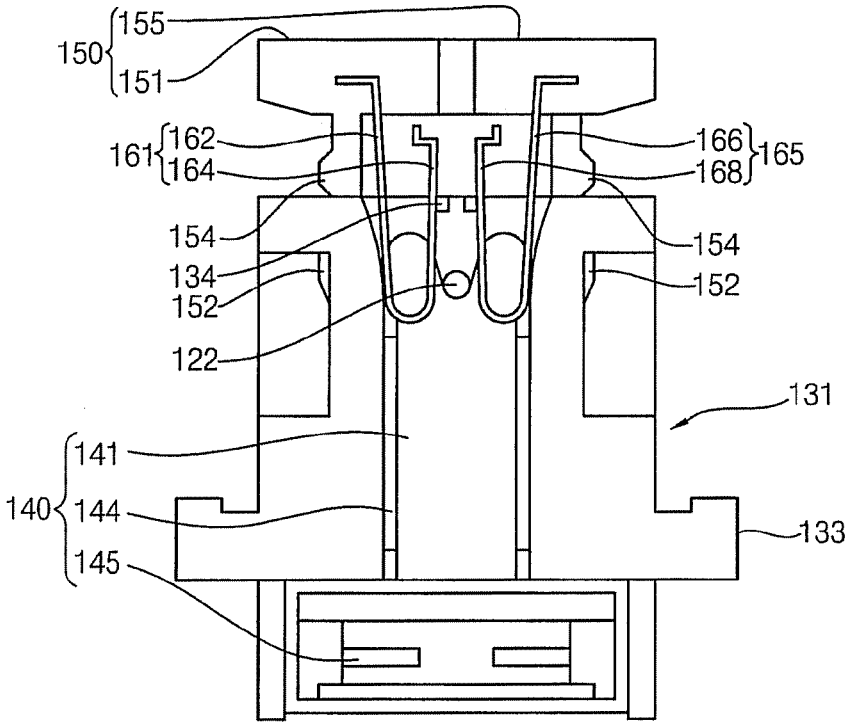
FIG. 8 is a cross-sectional view taken along line IV-IV' of the lamp socket in FIG. 7.

FIG. 8 is a cross-sectional view taken along line IV-IV' of the lamp socket 130 in FIG. 7. In FIG. 8, a first combining protrusion 152 of the socket cover 150 is inserted into the combining hole 137, and a second combining protrusion 154 is disposed outside of the combining hole 137, so that the socket cover 150 is disposed in the first position.

Referring to FIG. 8, when the socket cover 150 is disposed in the first position, the first and second contact portions 164 and 168 make contact with a side surface of the distance control protrusion 134. In this case, the first and second contact portions 164 and 168 are elastically deformed, to be separated from the electrode portion 122. The curved portions of the first and second lamp connecting terminals 161 and 165 may make contact with or may be separated from a curved surface formed on the inner surface of the socket body 131 defining the connecting hole 132.

Figure 9:
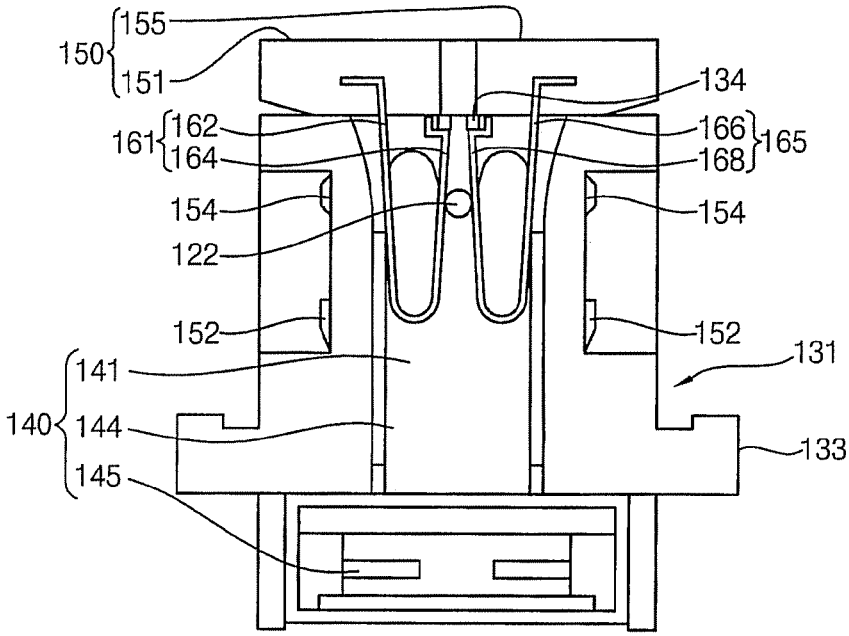
FIG. 9 is another cross-sectional view of the lamp socket in FIG. 7.

FIG. 9 is another cross-sectional view of the lamp socket 130 in FIG. 7. In FIG. 9, the first and second combining protrusions 152 of the socket cover 150 are inserted into the combining hole 137, so that the socket cover 150 is disposed in the second position.

Referring to FIG. 9, when the socket cover 150 is disposed in the second position, the upper portions of the first and second contact portions 164 and 168 correspond to a lower surface of the distance control protrusion 134. The first and second contact portions 164 and 168 are separated from the distance control protrusion 134 and are restored by an elastic force. The first and second contact portions 164 and 168 are restored to make contact with the electrode portion 122. Thus, the electrode portion 122 is constrained along the Z-axis direction and the Y-axis direction by the electrode supporting terminal 141, the first contact portion 164 and the second contact portion 168.

Figure 10:
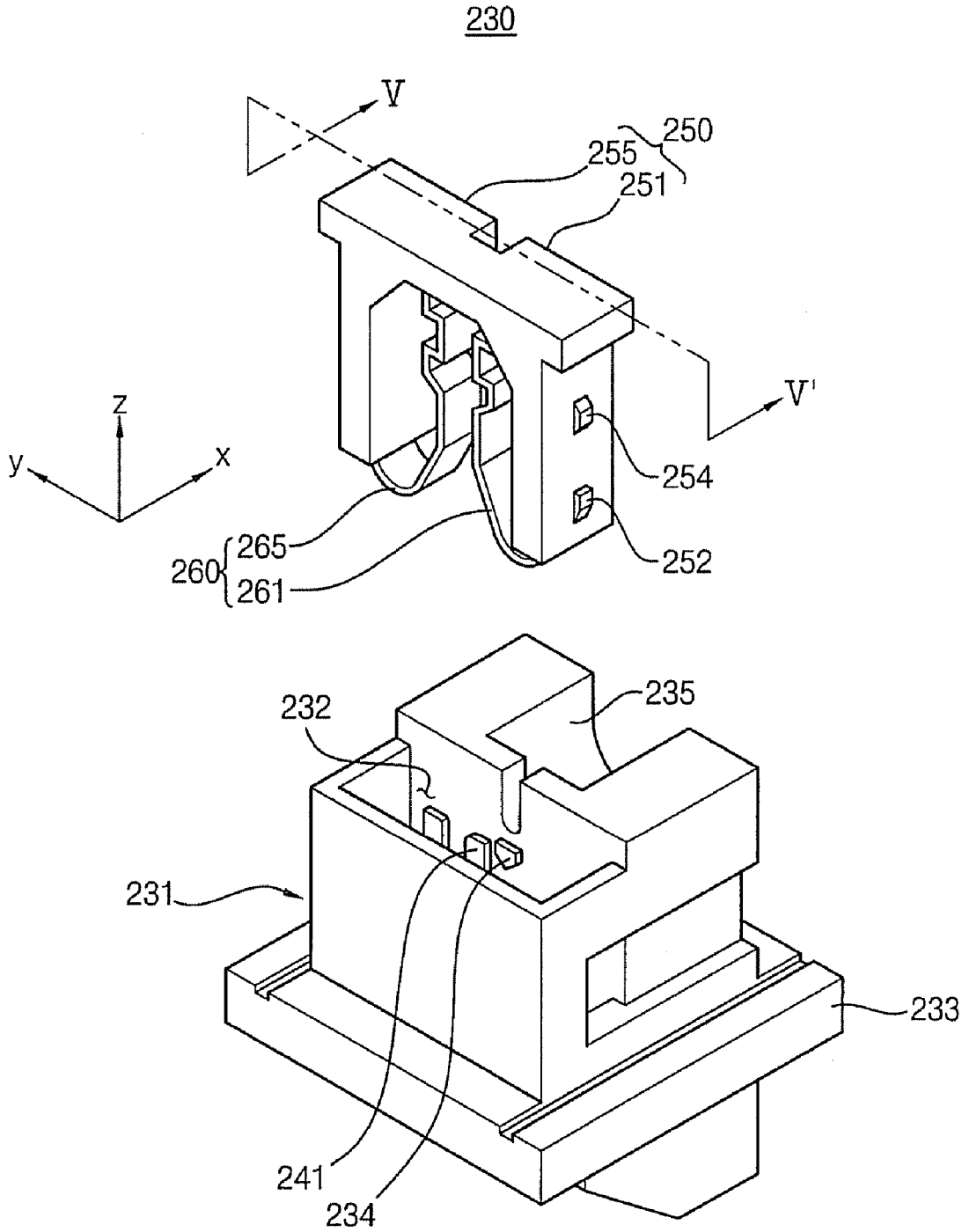
FIG. 10 is an exploded rear perspective view illustrating a third exemplary embodiment of a lamp socket according to the present invention.

FIG. 10 is an exploded rear perspective view illustrating a third exemplary embodiment of a lamp socket according to the present invention.

Referring to FIG. 10, the lamp socket 230 includes a socket body 231, a power supplying member, a socket cover 250 and an electrode fixing member 260. The lamp socket 230 according to the present exemplary embodiment is substantially the same as the lamp socket 30 illustrated in FIGS. 1 to 6, except for the socket body 231 and the electrode fixing member 260.

The socket body 231 according to the present exemplary embodiment is substantially the same as the socket body 31 illustrated in FIGS. 1 to 6, except that the socket body 231 includes a distance control protrusion 234. Thus, a connecting hole 232 opened to the Z-axis direction is formed through the socket body 231, and a combining hole (not shown) is formed through a side surface along the Y-axis direction in the socket body 231. The power supplying member is inserted into the connecting hole 232. An electrode supporting terminal 241 of the power supplying member is disposed in an upper portion of the connecting hole 232, and an inverter connecting hole (not shown) is disposed in a lower portion of the connecting hole 232 to be exposed to the positive X-axis direction.

Figure 11:
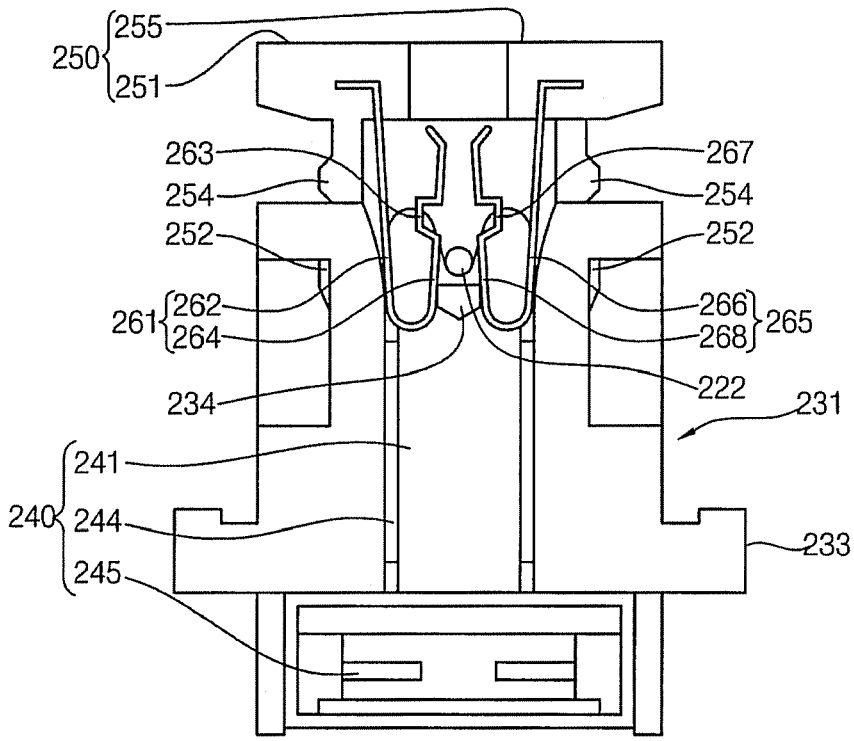
FIG. 11 is a cross-sectional view taken along line V-V' of the lamp socket in FIG. 10.

FIG. 11 is a cross-sectional view taken along line V-V' of the lamp socket 230 in FIG. 10.

Referring to FIGS. 10 and 11, the electrode fixing member 260 includes a first lamp connecting terminal 261 and a second lamp connecting terminal 265. The first lamp connecting terminal 261 includes a first fixing portion 262 and a first contact portion 264. The second lamp connecting terminal 265 includes a second fixing portion 266 and a second contact portion 268. The first and second connecting terminals 261 and 265 are substantially the same as the first and second lamp connecting terminals 61 and 65 illustrated in FIGS. 1 to 6, except for the first and second contact portions 264 and 268 illustrated in FIG. 11.

A first groove 263 having a convex shape towards the first fixing portion 262 is formed at a central portion of the first contact portion 264. A second groove 267 having the convex shape towards the second fixing portion 266 is formed at a central portion of the second contact portion 268. The first and second contact portions 264 and 268 may make contact with each other, when an external force is not applied. In this case, the first and second grooves 263 and 267 face each other, and form a predetermined receiving space.

The distance control protrusion 234 controls the separated distance between the first and second contact portions 264 and 268 in accordance with the position of the socket cover 250. The distance control protrusion 234 according to the present exemplary embodiment protrudes between the first and second contact portions 264 and 268 from an inner surface of the socket body 231 defining the connecting hole 232 along the positive X-axis direction. The distance control protrusion 234 is located at a lower portion of an electrode portion 222 disposed in the electrode supporting terminal 241.

In FIG. 11, a first combining protrusion 252 of the socket cover 250 is inserted into the combining hole (not shown), and a second combining protrusion 254 is disposed outside of the combining hole (not shown), so that the socket cover 250 is disposed in the first position. When the socket cover 250 is disposed in the first position, lower portions of the first and second contact portions 264 and 268 make contact with a side surface of the distance control protrusion 234. The first and second contact portions 264 and 268 are elastically deformed to be separated from each other and the electrode portion 222.

Figure 12:
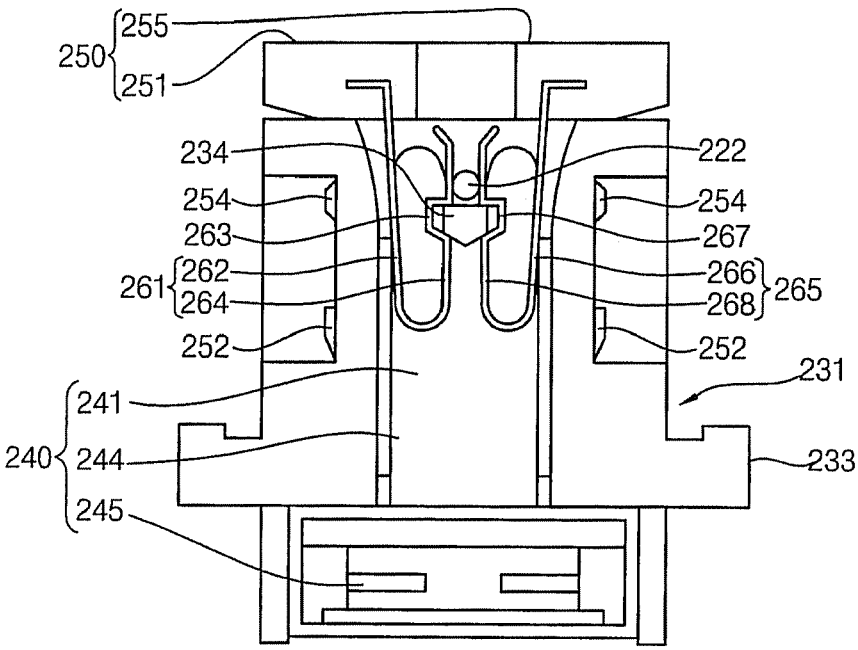
FIG. 12 is another cross-sectional view of the lamp socket in FIG. 10.

FIG. 12 is another cross-sectional view of the lamp socket 230 in FIG. 10. In FIG. 12, the first and second combining protrusions 252 and 254 of the socket cover 250 are inserted into the combining hole (not shown), so that the socket cover 250 is disposed in the second position.

Referring to FIG. 12, when the socket cover 250 is disposed in the second position, the distance control protrusion 234 is disposed in the receiving space formed by the first and second grooves 263 and 267 of the first and second contact portions 264 and 268, respectively. Thus, the first and second contact portions 264 and 268 are separated from the distance control protrusion 234 to be restored by the elastic force. Upper portions of the first and second contact portions 264 and 268 are restored to respectively make contact with the electrode portion 222. Thus, the electrode portion 222 is constrained along the Z-axis direction and the Y-axis direction by the electrode supporting terminal 241, the first contact portion 264 and the second contact portion 268.

Figure 13:
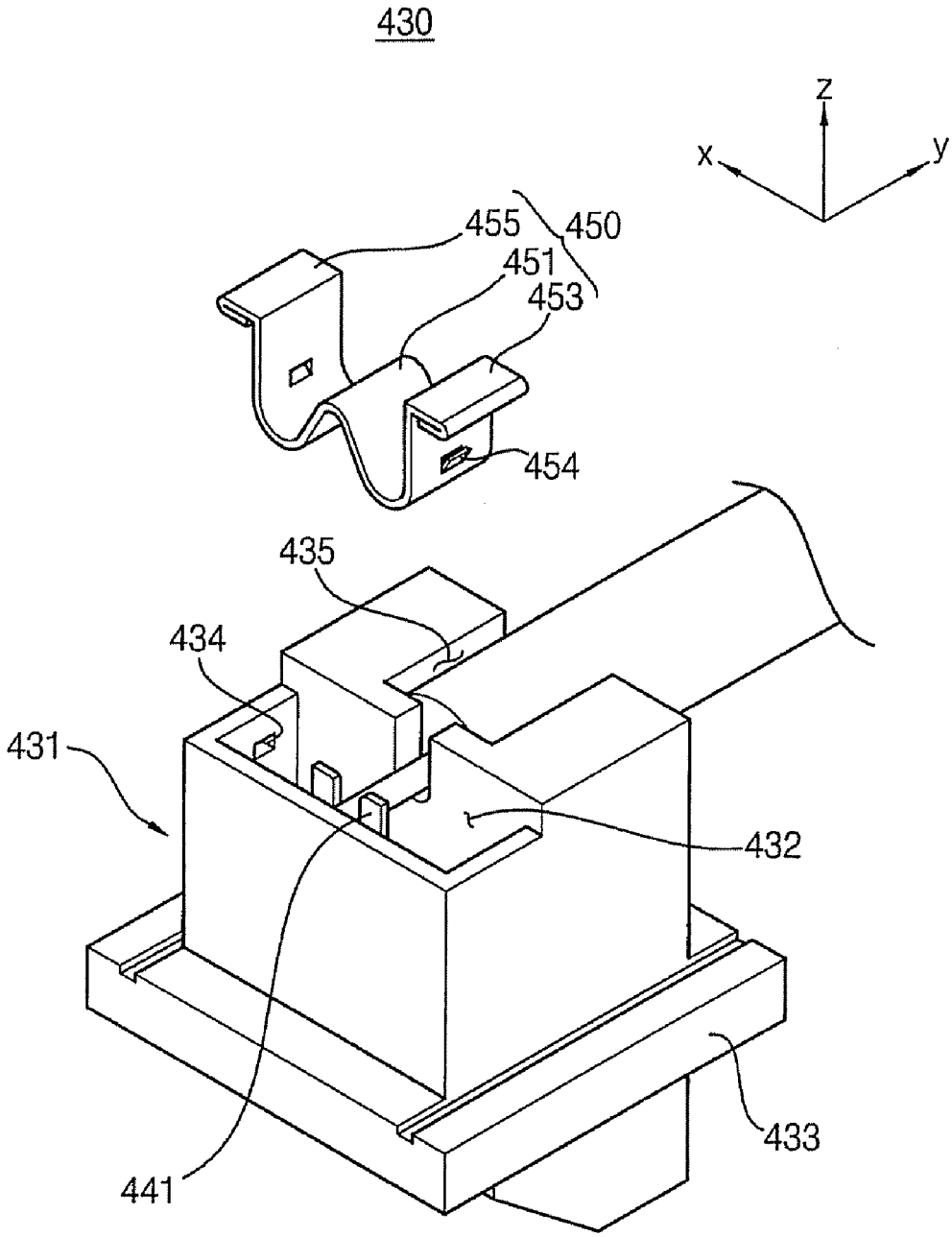
FIG. 13 is an exploded perspective view illustrating a fourth exemplary embodiment of a lamp socket according to the present invention.

FIG. 13 is an exploded perspective view illustrating a fourth exemplary embodiment of a lamp socket according to the present invention.

Referring to FIG. 13, the lamp socket 430 includes a socket body 431, a power supplying member and a socket cap 450.

A connecting hole 432 opened to the Z-axis direction is formed through the socket body 431. The socket body 431 according to the present exemplary embodiment is substantially the same as the socket body 31 illustrated in FIGS. 1 to 6, except that a combining hole 37 (in FIG. 1) along the Y-axis direction is eliminated from the socket body 431 and a hook groove 434 is formed in the socket body 431. The hook grooves 434 are respectively formed on inner surfaces of the socket body 431 defining the connecting hole 432 along the Y-axis direction.

The power supplying member is substantially the same as the power supplying member 40 illustrated in FIGS. 1 to 6. Thus, the power supplying member includes an electrode supporting terminal 441 and an inverter connecting terminal (not shown). The electrode supporting terminal 441 (FIG. 15) is exposed to an upper portion of the connecting hole 432, and the inverter connecting terminal is disposed at a lower portion of the connecting hole 432. A fixing groove in which an electrode portion 422 of the lamp is disposed, is formed in an upper portion of the electrode supporting terminal 441. The upper portion of the electrode supporting terminal 441 is formed at almost the same position or somewhat lower position than the hook groove 434.

Figure 14:
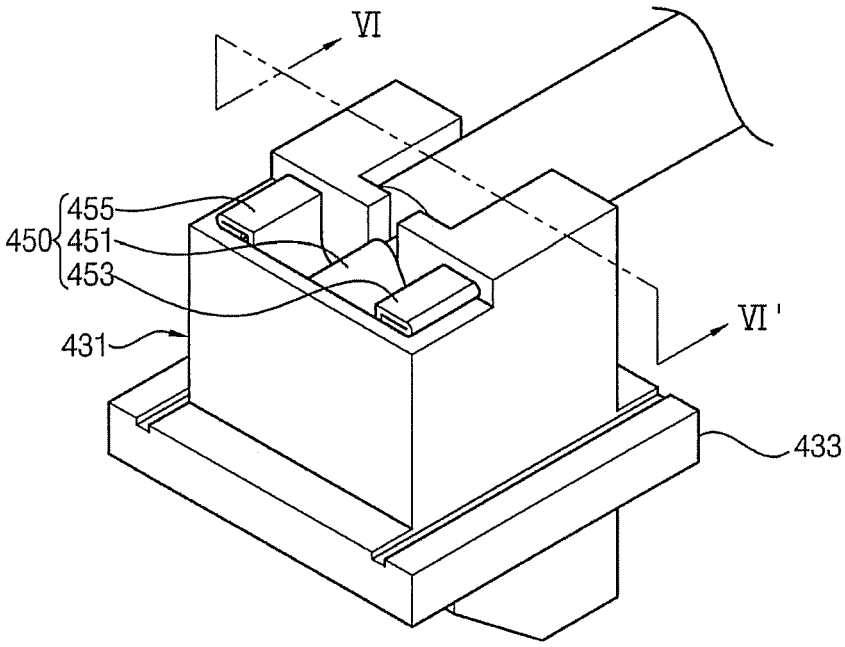
FIG. 14 is a perspective view illustrating the lamp socket in FIG. 13.
Figure 15:
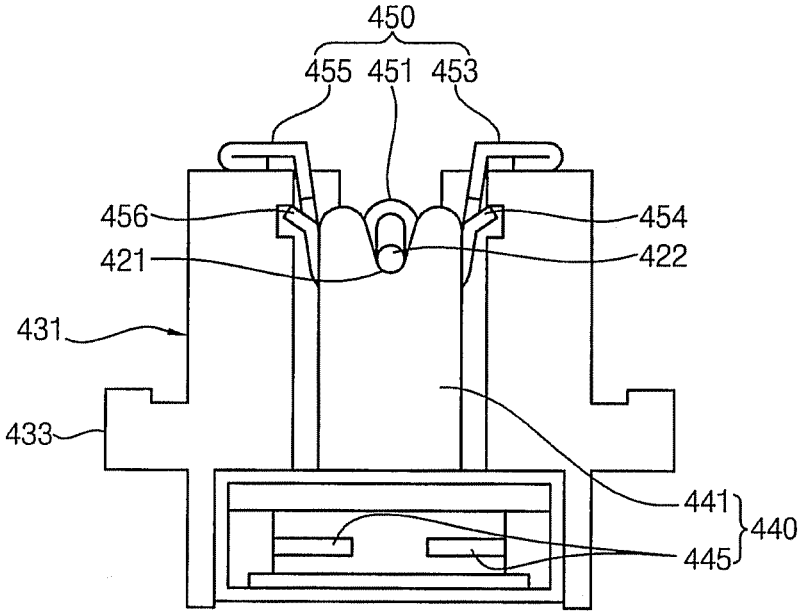
FIG. 15 is a cross-sectional view taken along line VI-VI' of the lamp socket in FIG. 14.

FIG. 14 is a perspective view illustrating the lamp socket 430 in FIG. 13. FIG. 15 is a cross-sectional view taken along line VI-VI' of the lamp socket 430 in FIG. 14.

Referring to FIGS. 14 and 15, the socket cap 450 is partially inserted into the connecting hole 432 to make contact with the electrode portion 422 disposed on the electrode supporting terminal 441. The socket cap 450 may include a conductive metal. The socket cap 450 includes a contact portion 451, a first hook portion 453 and a second hook portion 455.

The contact portion 451 encloses the upper portion of the electrode portion 422 and makes contact with the electrode portion 422. The contact portion 451 has substantially an N-shape. The first and second hook portions 453 and 455 are respectively curved from left and right end portions of the contact portion 451, and extend along an upper portion of the contact portion 451. The end portion of the first hook portion 453 is curved to the left side, to be hooked on the left upper portion of the socket body 431. The end portion of the second hook portion 455 is curved to the right side, to be hooked on the right upper portion of the socket body 431. Thus, the socket cap 450 has substantially a W-shape when viewed in a longitudinal direction of the lamp, for example, in the X-axis direction.

The first hook portion 453 is partially incised and protrudes to the left side, so that a first hook protrusion 454 is formed. The second hook portion 455 is partially incised and protrudes to the right side, so that a second hook protrusion 456 is formed. When the socket cap 450 is inserted from the upper portion of the connecting hole 432, the first and second hook protrusions 454 and 456 are compressed by the side surfaces of the socket body 431 defining the connecting hole 432 along the Y-axis direction. When the contact portion 451 of the socket cap 450 makes contact with the electrode portion 422, the first and second hook protrusions 454 and 456 are restored to be inserted into the hook groove 434. Thus, the electrode portion 422 is constrained along the Z-axis direction and the Y-axis direction by the electrode supporting terminal 441 and the socket cap 450.

Figure 16:
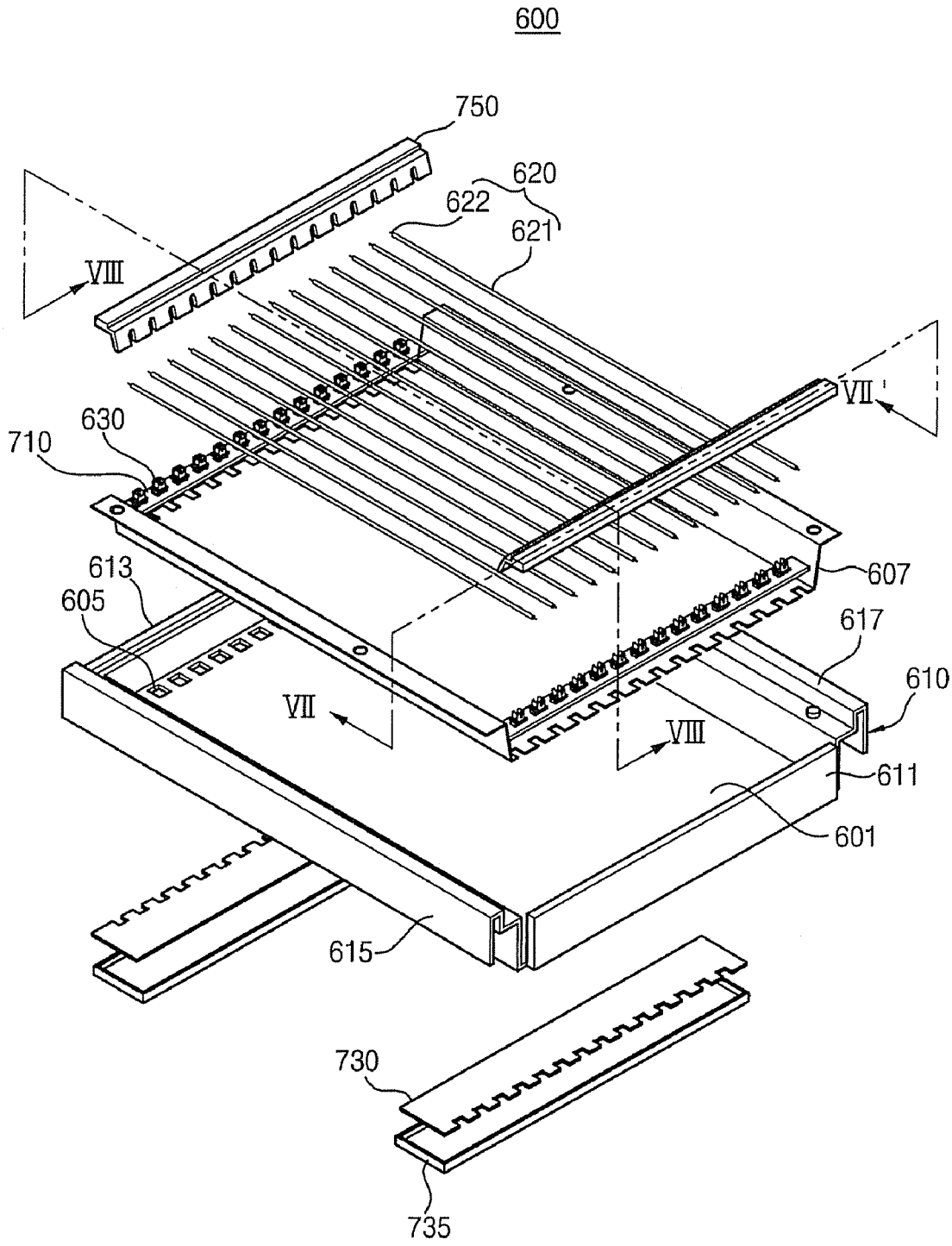
FIG. 16 is an exploded perspective view illustrating an exemplary embodiment of a backlight assembly according to the present invention.
Figure 17:
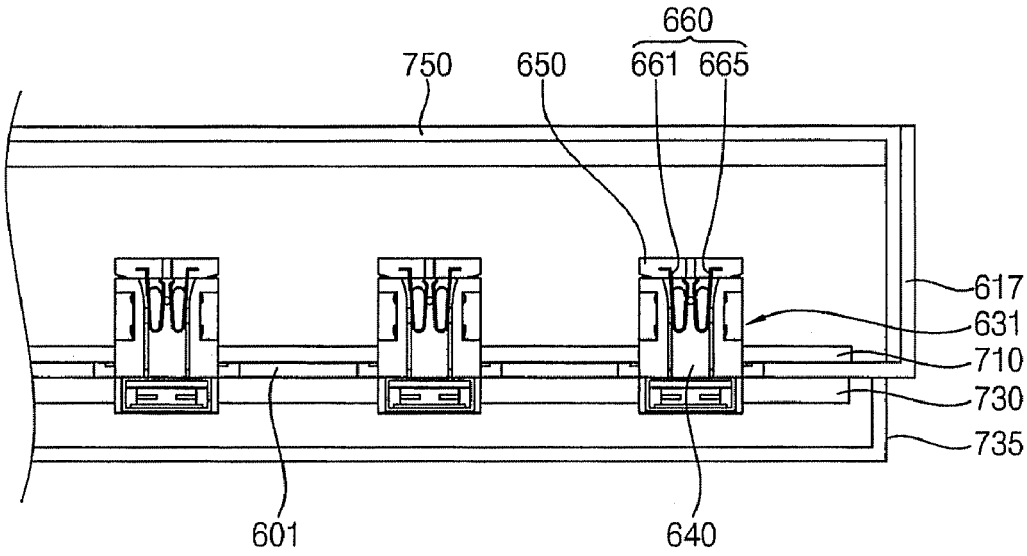
FIG. 17 is a cross-sectional view taken along line VII-VII' of the backlight assembly in FIG. 16.

FIG. 16 is an exploded perspective view illustrating an exemplary embodiment of a backlight assembly according to the present invention. FIG. 17 is a cross-sectional view taken along VII-VII' of the backlight assembly in FIG. 16.

Referring to FIGS. 16 and 17, the backlight assembly 600 includes a receiving container 610, a plurality of lamps 620 and a plurality of lamp sockets 630.

The receiving container 610 includes a bottom plate 601, a first side wall 611, a second side wall 613, a third side wall 615 and a fourth side wall 617. The first, second, third and fourth side walls 611, 613, 615 and 617 are disposed around the bottom plate 601. The first and second side walls 611 and 613 face each other. The third and fourth side walls 615 and 617 face each other, and are respectively connected to the first and second side walls 611 and 613. A stepped portion is formed in upper portions of the first, second, third and fourth side walls 611, 613, 615 and 617. A plurality of openings 605 is formed in the bottom plate 601 adjacent to the first and second side walls 611 and 613.

The lamp sockets 630 according to the present exemplary embodiment are substantially the same as the lamp socket 30 illustrated in FIGS. 1 to 6. Thus, each of the lamp sockets 630 includes a socket body 631, a power supplying member 640, a socket cover 650 and an electrode fixing member 660. Alternatively, the lamp sockets 630 may be replaced by the lamp socket 130 illustrated in FIGS. 7, 8 and 9, or the lamp socket 230 illustrated in FIGS. 10, 11 and 12, or the lamp socket 430 illustrated in FIGS. 13, 14 and 15.

The backlight assembly 600 may further include a connecting member 710.

The connecting member 710 has a plate shape extending along a longitudinal direction. A plurality of socket fixing portions is formed in the connecting member 710 separated from each other by a predetermined distance. The socket fixing portion according to the present exemplary embodiment may be a fixing hole or a fixing groove.

Each of the lamp sockets 630 is respectively inserted into the fixing hole formed in the connecting member 710. The connecting member 710 is disposed adjacent to the first and second side walls 611 and 613. The plurality of lamp sockets 630 inserted into the connecting member 710, is respectively inserted into the openings 605 formed through the bottom plate 601. The connecting hole formed through the socket body 631 is disposed to be connected to inner and outer sides of the receiving container 610. The electrode supporting terminal 641 of the power supplying member 640 is exposed to the upper portion of the connecting hole, for example the inner side of the receiving container 610. The inverter connecting terminal 645 (FIG. 18) of the power supplying member 640 is exposed to the lower portion of the connecting hole, for example, the outer side of the receiving container 610. Before each of the lamps 620 is combined with each of the lamp sockets 630, the first combining protrusions 652 of the socket cover 650 are inserted into the combining hole formed in the socket body 631, and the second combining protrusions 654 of the socket cover 650 are disposed outside of the combining hole.

Figure 18:
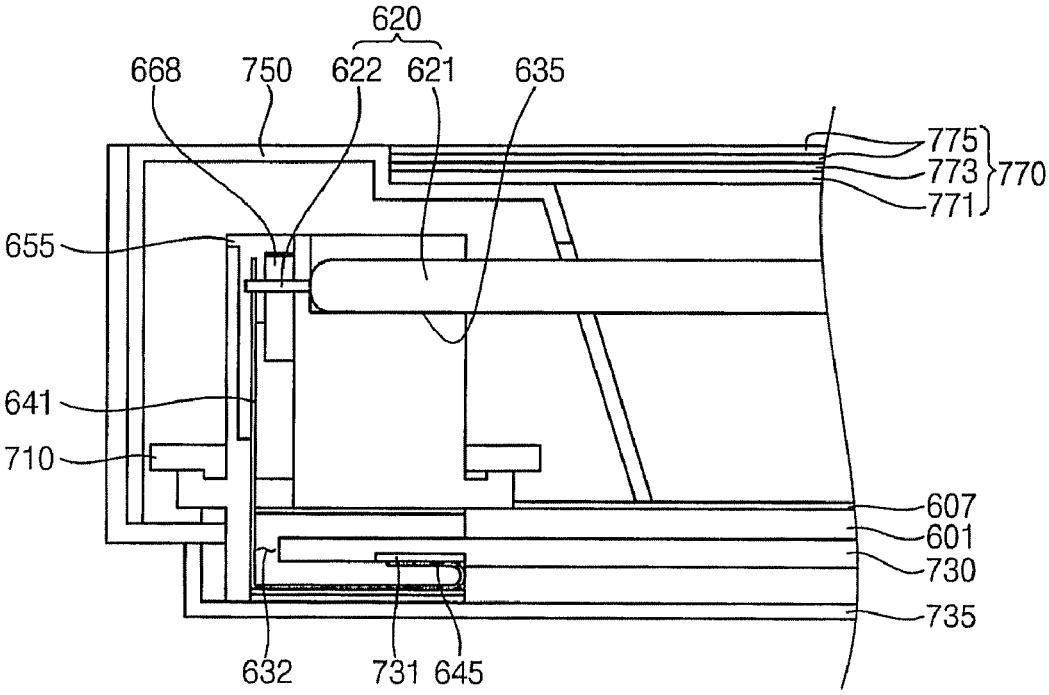
FIG. 18 is a cross-sectional view taken along line VIII-VIII' of the backlight assembly in FIG. 16.

FIG. 18 is a cross-sectional view taken along line VIII-VIII' of the backlight assembly in FIG. 16.

Referring to FIGS. 17 and 18, each of the lamps 620 is combined with respective lamp sockets 630 by a manual process or a lamp loading apparatus. The lamps 620 are disposed over the bottom plate 601 substantially parallel with the bottom plate 601 to emit light. A longitudinal direction of the lamps 620 is substantially parallel with a direction from the first side wall 611 to the second side wall 613.

Each of the lamps 620 includes a lamp body 621 and an electrode portion 622. The lamp body 621 has a long cylindrical shape, and includes discharge gas, for example, argon (Ar) and hydragyrum (Hg) (e.g., mercury) injected into the lamp. The electrode portion 622 is disposed at an end portion of the lamp body 621. The electrode portion 622 includes a discharge electrode and a lead wire. The discharge electrode is disposed inside of the lamp body 621, and the lead wire extends from the discharge electrode to outside of the lamp body 621. Alternatively, the lamps 620 may include an external electrode fluorescent lamp ("EEFL").

The end portion of the lamp body 621 is disposed at a lamp guide groove 635 formed in the socket body 631, and the electrode portion 622 is disposed at a supporting groove formed in the electrode supporting terminal 641. Then, the socket cover 650 is compressed to be disposed in the second position. As in the exemplary embodiments, the electrode fixing member 660 fixed to the socket cover 650 makes contact with the electrode portion 622.

The electrode fixing member 660 includes a first lamp connecting terminal 661 and a second lamp connecting terminal 665. The first and second lamp connecting terminals 661 and 665 respectively make contact with both sides of the electrode portion 622. The first and second lamp connecting terminals 661 and 665 make contact with the electrode portion 622 to be slid thereby. Advantageously, the excessive external force is prevented from being applied to the electrode portion 622 when the socket cover 650 is inserted into the connecting hole 632.

The backlight assembly 600 may further include a power supplying board 730 and a protective case 735. The power supplying board 730 is disposed on an outer surface of the bottom plate 601, to output a lamp driving voltage. The power supplying board 730 may include a printed circuit board ("PCB") and a power supplying element mounted on the PCB.

A lower portion of the connecting hole 632 of the socket body 631 is partially opened to the X-axis direction, for example a longitudinal direction of the lamps 620, as explained with respect to FIGS. 1 and 2. A plurality of protrusions is formed at a first edge of the power supplying board 730. A power output terminal is respectively formed at each protrusion. For example, the power output terminal may be formed by partially exposing a conductive line formed on the PCB. The protrusions correspond to each of the lamp sockets 630, and are inserted into a lower portion of each connecting hole 632. The inverter connecting terminal 645 makes physical contact with the power output terminal.

The protective case 735 covers the power supplying board 730, to protect the power supplying board 730 and to block influx and efflux of an electromagnetic wave.

The backlight assembly 600 may further include side covers 750 and an optical sheet 770.

The side covers 750 cover the lamp sockets 630 respectively disposed at the first and second side walls 611 and 613, to protect the lamp sockets 630. The optical sheet 770 enhances optical characteristics of light emitted from the lamps 620, and then emits the light therefrom. The optical sheet 770 may sequentially include a diffusion plate 771, a diffusion sheet 773 and condensing sheets 775. The optical sheet 770 may further include a reflective sheet 607 disposed between the lamps 620 and the bottom plate 601. The diffusion plate 771, the diffusion sheet 773 and the condensing sheets 775 are supported by the stepped portions formed in the third side wall 615, the fourth side wall 617 and the side covers 750.

As in the illustrated embodiments, the power supplying member of the lamp socket is separably combined with the electrode portion of the lamp and the power output terminal of the power supplying board and directly makes contact with the electrode portion of the lamp and the power output terminal of the power supplying board, respectively. Advantageously, an assembling performance between the lamp and the lamp socket, and an assembling performance between the lamp socket and the power supplying board may be enhanced.

In an illustrated embodiment, the electrode portion of the lamp may be disposed in the electrode supporting terminal of the power supplying member without the insertion force, and the electrode fixing member combined with the socket cover fixes the electrode portion to the electrode supporting terminal. Thus, damage due to the external force is decreased when the lamp is combined with the lamp socket, and the reliability of the electrical connection between the electrode portion and the power supplying member is enhanced.

Having described the exemplary embodiments of the present invention and its advantages, it is noted that various changes, substitutions and alterations can be made herein without departing from the spirit and scope of the present invention as defined by the appended claims.

What is claimed is:

1. A lamp socket comprising:

a socket body having a connecting hole formed through the socket body, the connecting hole being opened;

a power supplying member disposed in the connecting hole and having a single electrode supporting terminal having a supporting groove formed at an upper portion of the single electrode supporting terminal to support an electrode portion of a lamp disposed in the power supplying member, the single electrode supporting terminal being integrally formed with the power supplying member; and a socket cover insertable into the connecting hole to be separably combined with the socket body, to fix the electrode portion of the lamp.

2. The lamp socket of claim 1, further comprising an electrode fixing member including:

a first lamp connecting terminal having a first fixing portion combined with the socket cover, and a first contact portion upwardly curved from the first fixing portion to make contact with a first side of the electrode portion; and a second lamp connecting terminal having a second fixing portion combined with the socket cover to face the first fixing portion, and a second contact portion upwardly curved from the second fixing portion to make contact with a second side of the electrode portion.

3. The lamp socket of claim 2, wherein the first and second lamp connecting terminals to make contact with the electrode portion are disposed to have a W-shape when viewed in a longitudinal direction of the lamp.

4. The lamp socket of claim 2, wherein left and right inner surfaces of the socket body defining the connecting hole includes an inclined surface which guides the first and second lamp connecting terminals so that a distance between the first and second lamp connecting terminals becomes narrower when the socket cover is inserted into the connecting hole.

5. The lamp socket of claim 2, wherein the socket body further comprises a distance control protrusion protruded from at least one of a front inner surface and a rear inner surface of the socket body defining the connecting hole, the front and rear inner surfaces face the power supplying member, and the distance control protrusion is disposed between the first and second contact portions to control a distance between the first and second contact portions in accordance with a position of the socket cover with respect to the connecting hole.

6. The lamp socket of claim 5, wherein the first and second contact portions make contact with the distance control protrusion to be separated from the electrode portion when a lower portion of the socket cover is inserted into the connecting hole to be in a first position, and the first and second contact portions are separated from the distance control protrusion to respectively make contact with both sides of the electrode portion when the socket cover is inserted into the connecting hole to be in a second position that is lower than the first position.

7. The lamp socket of claim 6, wherein the distance control protrusion is disposed over the electrode portion, and upper portions of the first and second contact portions face a lower surface of the distance control protrusion in the second position.

8. The lamp socket of claim 6, wherein the first and second lamp connecting terminals have grooves that face each other to define a receiving space, and the distance control protrusion is disposed under the electrode portion, and is disposed in the receiving space in the second position.

9. The lamp socket of claim 2, wherein the power supplying member further comprises—an inverter connecting terminal integrally formed with the single electrode supporting terminal and disposed at the lower portion of the connecting hole, wherein the electrode portion is disposed on the supporting groove.

10. The lamp socket of claim 9, wherein the power supplying member further comprises guide portions protruded from left and right edges of the single electrode supporting terminal, and the first and second lamp connecting terminals are insertable between the guide portions.

11. The lamp socket of claim 2, wherein the socket cover comprises:

a first cover portion having a first fixing groove, into which the first fixing portion is inserted; and a second cover portion having a second fixing groove, into which the second fixing portion is inserted, the second cover portion being integrally formed with the first cover portion such that the second cover portion faces the first cover portion.

12. The lamp socket of claim 11, wherein combining holes are formed through the left and right inner surfaces of the socket body defining the connecting hole, and combining protrusions insertable into the combining holes are formed on side surfaces of the first and second cover portions.

13. The lamp socket of claim 1, wherein a lamp guide groove is formed at an upper surface of the socket body, the lamp guide groove allowing an end portion of the lamp to be disposed thereon.

14. The lamp socket of claim 1, further comprising a socket cap having a contact portion which encloses and makes contact with the electrode portion, and hook portions extended from left and right end portions of the contact portion to be hooked with left and right upper portions of the socket body, wherein the supporting groove supports an electrode portion of a lamp being disposed thereon.

15. The lamp socket of claim 14, wherein the socket cap comprises a metal.

16. The lamp socket of claim 14, wherein hook grooves are formed on left and right inner surfaces of the socket body defining the connecting hole, the left and right inner surfaces facing the hook portions, and each of the hook portions has a hook protrusion which is hooked with the hook grooves to prevent the socket cap from being separated.

17. A backlight assembly comprising:

a receiving container including a bottom plate having a plurality of openings formed through the bottom plate, and a side wall disposed on a peripheral portion of the bottom plate;

a plurality of lamps, each of the lamps including a lamp body disposed over the bottom plate, and an electrode portion formed at an end portion of the lamp body; and a plurality of lamp sockets, each of the lamp sockets including:

a socket body combined with each of the openings, and having a connecting hole formed through the socket body, the connecting hole being opened to inner and outer sides of the receiving container;

a power supplying member disposed in the connecting hole and having a single electrode supporting terminal having a supporting groove formed at an upper portion of the single electrode supporting terminal to support the electrode portion, the single electrode supporting terminal being integrally formed with the power supplying member; and a socket cover partially insertable into the connecting hole to be separably combined with the socket body to fix the electrode portion of the lamp.

18. The backlight assembly of claim 17, further comprising an electrode fixing member including:

a first lamp connecting terminal having a clamp-shape and which makes contact with a first side of the electrode portion; and a second lamp connecting terminal having the clamp-shape corresponding to the first lamp connecting terminal and which makes contact with a second side of the electrode portion.

19. The backlight assembly of claim 18, wherein a distance control protrusion is formed on an inner surface of the socket body defining the connecting hole, and the distance control protrusion is disposed between the first and second lamp connecting terminals to control a distance between the first and second lamp connecting terminals and the electrode portion in response to an external force applied to the socket cover.

20. The backlight assembly of claim 17, further comprising a power supplying board having a power output terminal formed on the power supplying board, the power output terminal making contact with the power supplying member exposed to a rear surface of the bottom plate.

21. The backlight assembly of claim 17, further comprising a connecting member having a plurality of socket fixing portions formed at the connecting member, the lamp sockets being fixed to the socket fixing portions to be aligned in the openings.

22. A method for assembling a lamp socket, the method comprising:

forming a connecting hole of a socket body through the socket body, the connecting hole being opened;

disposing a power supplying member in the connecting hole to support an electrode portion of a lamp disposed in the power supplying member, the power supplying member having a single electrode supporting terminal having a supporting groove formed at an upper portion of the single elect rode supporting terminal, the single electrode supporting terminal being integrally formed with the power supplying member; and separably combining a socket cover insertable into the connecting hole with the socket body; the socket cover being operative to fix the electrode portion of the lamp.

23. The method of claim 22, wherein the lamp socket includes an electrode fixing member having first and second lamp connecting terminals, and a first fixing portion of the first lamp connecting terminal is combined with the socket cover, a first contact portion of the first lamp connecting terminal is upwardly curved from the first fixing portion to make contact with a first side of the electrode portion, a second fixing portion of the second lamp connecting terminal is combined with the socket cover to face the fixing portion, and a second contact portion of the second lamp connecting terminal is upwardly curved from the second fixing portion to make contact with a second side of the electrode portion.

24. The method of claim 22, further comprising forming a lamp guide groove at an upper surface of the socket body, the lamp guide groove allowing an end portion of the lamp to be disposed thereon.

* * * * *